US010260785B2

(12) United States Patent
Yang et al.

(10) Patent No.: US 10,260,785 B2
(45) Date of Patent: Apr. 16, 2019

(54) OUTDOOR UNIT FOR HEAT RECOVERY VRF AIR CONDITIONING SYSTEM AND HEAT RECOVERY VRF AIR CONDITIONING SYSTEM

(71) Applicants: GD MIDEA HEATING & VENTILATING EQUIPMENT CO., LTD., Foshan (CN); MIDEA GROUP CO., LTD., Foshan (CN)

(72) Inventors: Guozhong Yang, Foshan (CN); Yueming Li, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 346 days.

(21) Appl. No.: 15/325,892

(22) PCT Filed: Apr. 27, 2016

(86) PCT No.: PCT/CN2016/080405

§ 371 (c)(1),
(2) Date: Jan. 12, 2017

(87) PCT Pub. No.: WO2016/188295

PCT Pub. Date: Dec. 1, 2016

(65) Prior Publication Data

US 2017/0191715 A1 Jul. 6, 2017

(30) Foreign Application Priority Data

May 25, 2015 (CN) ..... 2015 1 0270935

(51) Int. Cl.
*F25B 40/04* (2006.01)
*F24F 1/06* (2011.01)
(Continued)

(52) U.S. Cl.
CPC ..... *F25B 40/04* (2013.01); *F24F 1/06* (2013.01); *F24F 1/16* (2013.01); *F24F 3/147* (2013.01);
(Continued)

(58) Field of Classification Search
CPC ..... F25B 40/04; F25B 30/02; F25B 41/04; F25B 2400/075; F25B 47/00; F25B 43/02;
(Continued)

(56) References Cited

U.S. PATENT DOCUMENTS

2013/0213077 A1* 8/2013 Jin ..... F24F 3/065 62/324.6
2015/0292777 A1* 10/2015 Okano ..... F25B 5/02 62/129

FOREIGN PATENT DOCUMENTS

CN 101504210 8/2009
CN 103697614 4/2014
(Continued)

OTHER PUBLICATIONS

European Patent Application No. 16799184.3, Extended Search and Opinion dated Jun. 29, 2018, 8 pages.
(Continued)

*Primary Examiner* — Emmanuel E Duke
(74) *Attorney, Agent, or Firm* — Lathrop Gage LLP

(57) ABSTRACT

An outdoor unit for a heat recovery VRF air conditioning system and a heat recovery VRF air conditioning system are provided. The outdoor unit comprises: a compressor, having an exhaust port and a gas return port; a reversing assembly, having a first valve port, a second valve port, a third valve port and a fourth valve port; an outdoor heat exchanger, having a first end connected to the first valve port, and a second end connected to the second connector; a plurality of
(Continued)

one-way valves, wherein each one-way valve has a circulation end and a stop end, and each one-way valve is opened only in one direction from the circulation end to the stop end; a throttling element; and a gas-liquid separator.

20 Claims, 1 Drawing Sheet

(51) Int. Cl.

| | |
|---|---|
| ***F24F 1/16*** | (2011.01) |
| ***F24F 3/147*** | (2006.01) |
| ***F25B 13/00*** | (2006.01) |
| ***F25B 29/00*** | (2006.01) |
| ***F25B 39/02*** | (2006.01) |
| ***F25B 41/04*** | (2006.01) |

(52) U.S. Cl.
CPC ..... *F25B 13/00* (2013.01); *F25B 29/003* (2013.01); *F25B 39/028* (2013.01); *F25B 41/04* (2013.01); *F25B 2313/0253* (2013.01)

(58) Field of Classification Search
CPC ..... F25B 45/00; F25B 31/004; F25B 29/003; F25B 13/00; F25B 39/028; F25B 2313/0253; F24F 3/147; F24F 1/16; F24F 1/06
See application file for complete search history.

(56) References Cited

FOREIGN PATENT DOCUMENTS

| | | |
|---|---|---|
| CN | 103807917 | 5/2015 |
| CN | 104833010 | 8/2015 |
| JP | H1026377 | 1/1998 |
| WO | WO 2014103028 A1 | 7/2014 |
| WO | 2016188295 | 12/2016 |

OTHER PUBLICATIONS

International Search Report corresponding to International Application No. PCT/CN2016/080405, dated Aug. 5, 2016, 5 pages.
English Abstract of KR20000040513 corresponding to KR303680 to Mando Climate Control Corp published Jul. 5, 2000, 2 pages.

* cited by examiner

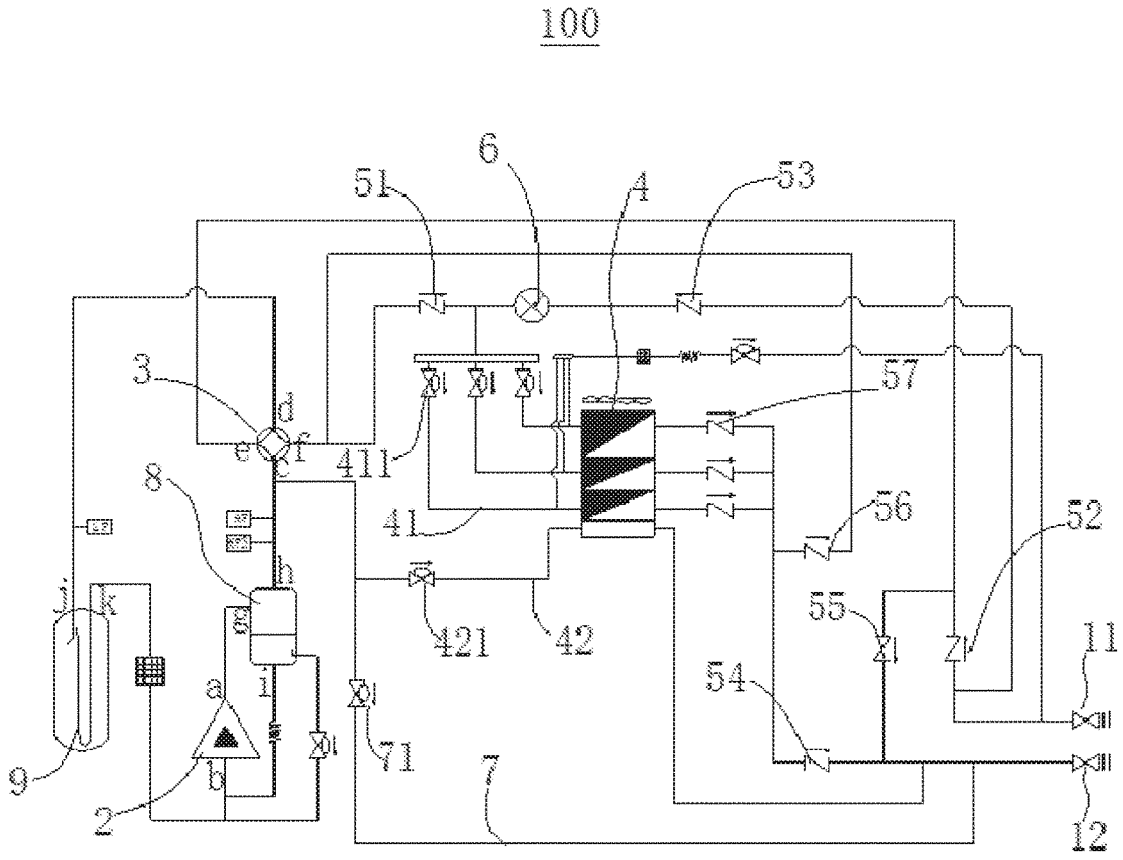
100
6
51
4
53
3
d
e
f
c
411
57
8
41
56
52
h
j
k
g
421
42
55
11
a
i
54
71
9
b
7
2
12

OUTDOOR UNIT FOR HEAT RECOVERY VRF AIR CONDITIONING SYSTEM AND HEAT RECOVERY VRF AIR CONDITIONING SYSTEM

CROSS-REFERENCE TO RELATED APPLICATION

The present application is a national phase entry under 35 USC § 371 of International Application PCT/CN2016/080405, filed Apr. 27, 2016, which claims the benefit of and priority to Chinese Patent Application No. 201510270935.6, filed May 25, 2015, the entire disclosure of which is incorporated herein by reference.

FIELD

The present disclosure relates to a technical field of refrigeration devices, and specifically, more particularly to an outdoor unit for a heat recovery VRF air conditioning system and a heat recovery VRF air conditioning system.

BACKGROUND

With development of air conditioning technology and enhancement of people's environmental protection awareness, a heat recovery VRF (Variable Refrigerant Flow) air conditioning system becomes increasingly popular in the market. When the heat recovery VRF air conditioning system is in a heating mode, a refrigerant contained in an outdoor unit serving as an evaporator is less than that contained in the outdoor unit serving as a condenser when in a cooling mode, and the redundant refrigerant is usually stored in a gas-liquid separator. Specifically, in the heating mode, the refrigerant is throttled and depressurized by a throttling element in a refrigerant flow direction switching device, and then forms a gas-liquid two-phase refrigerant to enter a pipe; more gaseous refrigerant is stored in the pipe, so that the amount of the refrigerant stored in the pipe is little, while more liquid refrigerant is stored in the gas-liquid separator, and even overflows the gas-liquid separator, which directly results in a drop of a suction-superheat degree of the compressor.

In order to increase the suction-superheat degree of the compressor, in the prior art, an exhaust port of the compressor is usually in communication with a gas return port thereof via a hot gas bypass solenoid valve. When the suction-superheat degree of the compressor decreases, the hot gas bypass solenoid valve is opened to increase the suction-superheat degree, which however directly reduces energy efficiency of the heat recovery VRF air conditioning system.

SUMMARY

The present disclosure seeks to solve at least one of the problems existing in the related art to at least some extent.

To this end, one objective of the present invention is to provide an outdoor unit for a heat recovery VRF air conditioning system, which is conductive to obtaining a suction-superheat degree of a compressor, and meanwhile improves energy efficiency of the heat recovery VRF air conditioning system.

Another objective of the present invention is to provide a heat recovery VRF air conditioning system, including the above-described outdoor unit.

The outdoor unit for the heat recovery VRF air conditioning system according to the present invention, the outdoor unit has a first connector and a second connector, and includes: a compressor having an exhaust port and a gas return port; a reversing assembly having a first valve port, a second valve port, a third valve port and a fourth valve port, in which the first valve port is connected to the exhaust port, the second valve port is connected to the gas return port, and the third valve port is connected to the first connector; an outdoor heat exchanger, having a first end connected to the fourth valve port, and a second end connected to the second connector; a plurality of one-way valves, in which each one-way valve has a circulation end and a stop end, and each one-way valve is opened only in one direction from the circulation end to the stop end; the plurality of one-way valves includes a first one-way valve, a second one-way valve, a third one-way valve, a fourth one-way valve, a fifth one-way valve and a sixth one-way valve; the circulation end of the first one-way valve is connected to the fourth valve port, and the stop end of the first one-way valve is connected to the first end of the outdoor heat exchanger; the circulation end of the second one-way valve is connected to the first connector, and the stop end of the second one-way valve is connected to the third valve port; the circulation end of the third one-way valve is connected between the second one-way valve, and the first connector and the stop end of the third one-way valve is connected to the first end of the outdoor heat exchanger; the circulation end of the fourth one-way valve is connected to the second end of the outdoor heat exchanger, and the stop end of the fourth one-way valve is connected to the second connector; the circulation end of the fifth one-way valve is connected between the second one-way valve and the third valve port, and the stop end of the fifth one-way valve is connected between the fourth one-way valve and the second connector; the circulation end of the sixth one-way valve is connected between the fourth one-way valve and the outdoor heat exchanger, and the stop end of the sixth one-way valve is connected between the first one-way valve and the fourth valve port; a throttling element connected in series between the third one-way valve and the outdoor heat exchanger; and a gas-liquid separator, including a second inlet and a gas outlet, in which the second inlet is connected to the second valve port, and the gas outlet is connected to the gas return port.

With the outdoor unit according to embodiments of the present invention, when the heat recovery VRF air conditioning system is in a heating mode, all of the throttling elements in the refrigerant flow direction switching device are opened, the refrigerant is throttled and depressurized by the throttling element connected in series between the third one-way valve and the outdoor heat exchanger before the refrigerant enters the outdoor heat exchanger, such that pressure of the two-phase refrigerant in the pipe is improved and dryness thereof is reduced, and hence more refrigerant may be stored in the pipe to reduce the amount of the refrigerant stored in the gas-liquid separator, which improves the suction-superheat degree of the compressor, and meanwhile improve the energy efficiency of the heat recovery VRF air conditioning system.

According to some embodiments for the present invention, the outdoor heat exchanger includes a plurality of first heat exchange passages arranged successively in an up-and-down direction, and a first control valve for controlling a refrigerant to flow or stop is connected in series between a first end of each first heat exchange passage and the first one-way valve.

Further, the outdoor unit for the heat recovery VRF air conditioning system includes a plurality of seventh one-way valves, the plurality of seventh one-way valves are provided in one to one correspondence with the plurality of first heat exchange passages, a circulation end of each seventh one-way valve is connected to a second end of the corresponding first heat exchange passage, and a stop end of each seventh one-way valve is connected to the sixth one-way valve.

Further, the outdoor heat exchanger includes a second heat exchange passage located at the lowest portion thereof, two ends of the second heat exchange passage are connected to the exhaust port and the second connector respectively, and a second control valve for controlling the refrigerant to flow or stop is connected in series between the second heat exchange passage and the exhaust port.

Further, the throttling element is an electronic expansion valve.

According to some embodiments of the present invention, the outdoor unit for the heat recovery VRF air conditioning system further includes a gas supplement passage, two ends of the gas supplement passage are connected to the exhaust port and the second connector respectively, and a third control valve for controlling the refrigerant to flow or stop is connected to the gas supplement passage in series.

Further, the third control valve is a solenoid valve.

According to some embodiments of the present invention, the outdoor unit for the heat recovery VRF air conditioning system further includes an oil separator, the oil separator comprises a first inlet, a refrigerant outlet and an oil outlet, the first inlet is connected to the exhaust port, the refrigerant outlet is connected to the first valve port, and the oil outlet is connected to the gas return port.

A heat recovery VRF air conditioning system according to the present invention includes the above-described outdoor unit.

The heat recovery VRF air conditioning system according to embodiments of the present invention, by providing the above-described outdoor unit for the heat recovery VRF air conditioning system, may improve the suction-superheat degree of the compressor, and meanwhile improve the energy efficiency of the heat recovery VRF air conditioning system.

BRIEF DESCRIPTION OF THE DRAWINGS

FIG. 1 is a schematic view of an outdoor unit according to an embodiment of the present invention;

REFERENCE NUMERALS

100: outdoor unit;
11: first connector; 12: second connector;
2: compressor; a: exhaust port; b: gas return port;
3: reversing assembly; c: first valve port; d: second valve port; e: third valve port; f: fourth valve port;
4: outdoor heat exchanger; 41: first heat exchange passage; 411: first control valve; 42: second heat exchange passage; 421: second control valve;
51: first one-way valve; 52: second one-way valve; 53: third one-way valve; 54: fourth one-way valve; 55: fifth one-way valve; 56: sixth one-way valve; 57: seventh one-way valve;
6: throttling element;
7: gas supplement passage; 71: third control valve;
8: oil separator; g: first inlet; h: refrigerant outlet; i: oil outlet;
9: gas-liquid separator; j: second inlet; k: gas outlet;

DETAILED DESCRIPTION

Description will be made in detail to embodiments of the present disclosure, and examples of the embodiments will be illustrated in drawings. The embodiments described herein with reference to drawings are explanatory, illustrative, and used to generally understand the present disclosure. The embodiments shall not be construed to limit the present disclosure.

In the specification of the present disclosure, it should be understood that the terms such as "central", "longitudinal", "lateral", "length", "width", "thickness", "upper", "lower", "front", "rear", "left", "right", "vertical", "horizontal", "top", "bottom", "inner", "outer", "clockwise", "counter-clockwise", "axial", "radial", "circumferential", etc. should be construed to refer to the orientation as then described or as shown in the drawings under discussion. These relative terms are for convenience and simplifying of description, and do not alone indicate or imply that the device or element referred to must have a particular orientation, or be constructed or operated in a particular orientation. Therefore, these relative terms should not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interactions of two elements, which can be understood by those skilled in the art according to specific situations.

An outdoor unit 100 for a heat recovery VRF air conditioning system according to embodiments of the present invention will be described below with reference to FIG. 1. The outdoor unit 100 has a first connector 11 and a second connector 12, and the outdoor unit 100 is assembled with a refrigerant flow direction switching device and a plurality of indoor units via the first connector 11 and the second connector 12 to form the heat recovery VRF air conditioning system for adjusting indoor temperature.

The heat recovery VRF air conditioning system has a pure cooling mode, a main cooling mode, a main heating mode and a pure heating mode. The pure cooling mode refers that all of the operating indoor units perform cooling; the pure heating mode refers that all of the operating indoor units perform heating; the main cooling mode refers that part of indoor units perform cooling and another part of indoor units perform heating, cooling load is greater than heating load, and the outdoor heat exchanger 4 is served as a condenser; the main heating mode refers that part of indoor units perform heating and another part of indoor units perform cooling, heating load is greater than cooling load, and the outdoor heat exchanger 4 is served as a evaporator. For ease of description, a heating mode in embodiments of the present invention includes the main heating mode and the pure heating mode, and a cooling mode includes the main cooling mode and the pure cooling mode.

The outdoor unit 100 for the heat recovery VRF air conditioning system according to embodiments of the present invention, may include a compressor 2, a reversing assembly 3, the outdoor heat exchanger 4, a plurality of one-way valves, a throttling element 6 and a gas-liquid separator 9, in which the compressor 2 has an exhaust port a and a gas return port b. It should be noted that, the structure and working principle of the compressor 2 are well known in the related art, and thus will not be described in detail herein.

The reversing assembly 3 has a first valve port c, a second valve port d, a third valve port e and a fourth valve port f, in which the first valve port c is in communication with one of the third valve port e and the fourth valve port f, and the second valve port d is in communication with the other of the third valve port e and the fourth valve port f That is to say, when the first valve port c is in communication with the third valve port e, the second valve port d is in communication with the fourth valve port f, and when the first valve port c is in communication with the fourth valve port f, the second valve port d is in communication with the third valve port e. Preferably, the reversing assembly 3 is a four-way valve, but it should be understood that the reversing assembly 3 may also be formed as other structures, as long as the structure has the first valve port c, the second valve port d, the third valve port e, and the fourth valve port f, and meanwhile has a direction reversing function.

The first valve port c is connected to the exhaust port a, the second valve port d is connected to the gas return port b, the third valve port e is connected to the first connector 11, a first end of the outdoor heat exchanger 4 is connected to the fourth valve port f, and a second end of the outdoor heat exchanger 4 is connected to the second connector 12. It should be understood that, the outdoor unit 100 may further include a fan for directing wind to the outdoor heat exchanger 4 to improve heat exchange efficiency of the outdoor heat exchanger 4.

Each one-way valve has a circulation end and a stop end, and each one-way valve is opened only in one direction from the circulation end to the stop end, that is to say, the refrigerant only may enter the one-way valve via the circulation end and flow out via the stop end of the one-way valve, and not the other way around, such that the one-way valve has an effect that it may be opened only in one direction.

The plurality of one-way valves include a first one-way valve 51, a second one-way valve 52, a third one-way valve 53, a fourth one-way valve 54, a fifth one-way valve 55 and a sixth one-way valve 56. The circulation end of the first one-way valve 51 is connected to the fourth valve port f, and the stop end of the first one-way valve 51 is connected to the first end of the outdoor heat exchanger 4. Thus, by providing the first one-way valve 51, the refrigerant may only flow from the fourth valve port f to the first end of the outdoor heat exchanger 4, rather than flow from the first end of the outdoor heat exchanger 4 to the fourth valve port f.

The circulation end of the second one-way valve 52 is connected to the first connector 11, and the stop end of the second one-way valve 52 is connected to the third valve port e. Thus, by providing the second one-way valve 52, the refrigerant may only flow from the first connector 11 to the third valve port e, rather than flow from the third valve port e to the first connector 11.

The circulation end of the third one-way valve 53 is connected between the second one-way valve 52 and the first connector 11, and the stop end of the third one-way valve 53 is connected to the first end of the outdoor heat exchanger 4. Thus, by providing the third one-way valve 53, the refrigerant may only flow from the first connector 11 to the first end of the outdoor heat exchanger 4, rather than flow from the first end of the outdoor heat exchanger 4 to the first connector 11.

The circulation end of the fourth one-way valve 54 is connected to the second end of the outdoor heat exchanger 4, and the stop end of the fourth one-way valve 54 is connected to the second connector 12, thus, by providing the fourth one-way valve 54, the refrigerant may only flow from the second end of the outdoor heat exchanger 4 to the second connector 12, while may not flow from the second connector 12 to the second end of the outdoor heat exchanger 4.

The circulation end of the fifth one-way valve 55 is connected between the second one-way valve 52 and the third valve port e, and the stop end of the fifth one-way valve 55 is connected between the fourth one-way valve 54 and the second connector 12. Thus, by providing the fifth one-way valve 55, the refrigerant may only flow from the third valve port e to the second connector 12, rather than flow from the second connector 12 to the third valve port e.

The circulation end of the sixth one-way valve 56 is connected between the fourth one-way valve 54 and the outdoor heat exchanger 4, and the stop end of the sixth one-way valve 56 is connected between the first one-way valve 51 and the fourth valve port f Thus, by providing the sixth one-way valve 56, the refrigerant may only flow from the second end of the outdoor heat exchanger 4 to the fourth valve port f, rather than flow from the fourth valve port f to the second end of outdoor heat exchanger 4.

The gas-liquid separator 9 includes a second inlet j and a gas outlet k, the second inlet j is connected to the second valve port d, and the gas outlet k is connected to the gas return port b. Thus, by providing the gas-liquid separator 9 between the second valve port d and the gas return port b of the compressor 2, the refrigerant discharged from the second valve port d enters the gas-liquid separator 9 and undergoes gas-liquid separation therein, and the separated gaseous refrigerant may be discharged from the gas outlet k to the compressor 2, while the liquid refrigerant may be stored in the gas-liquid separator 9, such that a liquid impact phenomenon of the compressor 2 is avoided, and operational reliability of the outdoor unit 100 is improved.

The throttling element 6 is connected in series between the third one-way valve 53 and the outdoor heat exchanger 4; when the VRF air conditioning system is in the heating mode, all of the throttling elements in the refrigerant flow direction switching device are opened, and the refrigerant is throttled and depressurized by the throttling element 6 before the refrigerant enters the outdoor heat exchanger 4, such that pressure of the two-phase refrigerant in the pipe is improved and dryness thereof is reduced, so as to increase the amount of the refrigerant in the pipe and further reduce the amount of the refrigerant stored in the gas-liquid separator 9, which improves a suction-superheat degree of the compressor 2, and meanwhile improves energy efficiency of the heat recovery VRF air conditioning system.

In order to conveniently describe the refrigerant flow direction of the outdoor unit 100, an application of the outdoor unit 100 in the heat recovery VRF air conditioning system will be described as follows, in which the outdoor unit 100 has two modes: when the heat recovery VRF air conditioning system is in the pure cooling mode, the outdoor unit 100 operates in a first mode; and when the heat recovery VRF air conditioning system is in the pure heating mode, the outdoor unit 100 operates in a second mode. When the plurality of indoor units are in the cooling mode and the heating mode simultaneously, the outdoor unit 100 operates in the first mode or in the second mode according to a judgment about the system.

In the first mode: the first valve port c of the reversing assembly 3 is in communication with the fourth valve port f, the second valve port d is in communication with the third valve port e, and the refrigerant flow direction of the heat recovery VRF air conditioning system is in such a way: the compressor 2—the first valve port c of the reversing assembly 3—the fourth valve port f of the reversing assembly 3—the first one-way valve 51—the outdoor heat exchanger 4—the fourth one-way valve 54—the second connector 12—the refrigerant flow direction switching device—the indoor units—the first connector 11—the second one-way valve 52—the third valve port e of the reversing assembly 3—the second valve port d of the reversing assembly 3—the compressor 2.

In the second mode: the first valve port c of the reversing assembly 3 is in communication with the third valve port e, the second valve port d is in communication with the fourth valve port f, and when the heat recovery VRF air conditioning system is in the pure heating mode, the refrigerant flow direction of the heat recovery VRF air conditioning system is in such a way: the compressor 2—the first valve port c of the reversing assembly 3—the third valve port e of the reversing assembly 3—the fifth one-way valve 55—the second connector 12—the refrigerant flow direction switching device—the indoor units—the first connector 11—the third one-way valve 53—the throttling element 6—the outdoor heat exchanger 4—the sixth one-way valve 56—the fourth valve port f of the reversing assembly 3—the second valve port d of the reversing assembly 3—the compressor 2.

When the heat recovery VRF air conditioning system is in the main heating mode, the gaseous refrigerant with high temperature and high pressure discharged from the outdoor unit 100 first enters the heating indoor units through the refrigerant flow direction switching device and is condensed into the liquid refrigerant with high temperature and high pressure; then, the refrigerant is divided into two parts, in which a first part flows into the cooling indoor units to be vaporized, and a second part flows into the refrigerant flow direction switching device to be throttled; and then the two parts are merged, and throttled and depressurized by the throttling element 6 before flowing back into the outdoor heat exchanger 4, then flow back into the outdoor heat exchanger 4 to be vaporized, and finally flow back into the compressor 2 again.

Meanwhile it is known from the above description that, in a case of requirement for cooling and heating modes of the indoor units at the same time, whether the outdoor unit 100 is in the first mode or in the second mode, when the heat recovery VRF air conditioning system is in the main cooling mode, the outdoor unit 100 outputs a mixture of the gaseous refrigerant and the liquid refrigerant into the refrigerant flow direction switching device, and after the gas-liquid separation conducted by the refrigerant flow direction switching device, the superheated gaseous refrigerant enters the heating indoor units to perform heating, and the subcooled liquid refrigerant enters the cooling indoor units to perform refrigerating; when the heat recovery VRF air conditioning system is in the pure heating mode or in the main heating mode, the outdoor unit 100 outputs the gaseous refrigerant with high temperature and high pressure; when the heat recovery VRF air conditioning system is in the pure cooling mode, the outdoor unit 100 outputs the liquid refrigerant. The first through sixth one-way valves 51-56 not only have an effect of flow path separation, but also ensure that the refrigerant of the outdoor unit 100 enters the refrigerant flow direction switching device via the second connector 12.

With the outdoor unit 100 for the heat recovery VRF air conditioning system according to embodiments of the present invention, when the heat recovery VRF air conditioning system is in the heating mode, all of the throttling elements in the refrigerant flow direction switching device are opened, the refrigerant is throttled and depressurized by the throttling element 6 connected in series between the third one-way valve 53 and the outdoor heat exchanger 4 before the refrigerant enters the outdoor heat exchanger 4, such that the pressure of the two-phase refrigerant in the pipe is improved and the dryness thereof is reduced, and more refrigerant may be stored in the pipe to reduce the amount of the refrigerant stored in the gas-liquid separator 9, which improves the suction-superheat degree of the compressor 2, reduces energy consumption of the compressor, and meanwhile improves the energy efficiency of the heat recovery VRF air conditioning system.

According to some embodiments of the present invention, as shown in FIG. 1, the outdoor heat exchanger 4 includes a plurality of first heat exchange passages 41 arranged successively in an up-and-down direction, and a first control valve 411 for controlling the refrigerant to flow or stop is connected in series between a first end of each first heat exchange passage 41 and the first one-way valve 51. That is to say, a use state of each first heat exchange passage 41 is controlled by the corresponding first control valve 411, and first heat exchange passages 41 are independent from each other. Thus, it is possible to control the number of the first heat exchange passages 41 in use by controlling the open state of the plurality of first control valves 411, such that the volume of the outdoor heat exchanger 4 is further adjusted, and the refrigerant state of the second connector 12 is adjusted by making the outdoor heat exchanger 4 cooperate with the compressor 2, the fan and the refrigerant flow direction switching device. For example, the plurality of first heat exchange passages 41 may be used simultaneously to meet a high power requirement, while only one of the first heat exchange passage 41 may be used to meet a small power requirement. Simply, the outdoor heat exchanger 4 may be controlled in sections, which may meet different power requirements, and make the control more accurate. Optionally, each first control valve 411 may be a solenoid valve.

Further, the outdoor unit 100 further includes a plurality of seventh one-way valves 57, the plurality of seventh one-way valves 57 are provided in one to one correspondence with the plurality of first heat exchange passages 41, the circulation end of each seventh one-way valve 57 is connected to a second end of the corresponding first heat exchange passage 41, and the stop end of each seventh one-way valve 57 is connected to the sixth one-way valve 56. That is to say, one first heat exchange passage 41 corresponds to one seventh one-way valve 57, and the refrigerant may enter the seventh one-way valve 57 only via the circulation end of the seventh one-way valve 57, and flow out via the stop end of the seventh one-way valve 57, but may not enter the seventh one-way valve 57 via the stop end of the seventh one-way valve 57. By providing the seventh one-way valve 57, the refrigerant may only flow from the first heat exchange passage 41 to the sixth one-way valve 56, rather than flow from the sixth one-way valve 56 to the first heat exchange passage 41, which further ensures the operational reliability of the outdoor unit 100.

In an further embodiment of the present invention, the outdoor heat exchanger 4 further includes a second heat exchange passage 42 located at the lowest portion thereof, two ends of the second heat exchange passage 42 are connected to the exhaust port a and the second connector 12 respectively, and a second control valve 421 for controlling the refrigerant to flow or stop is connected in series between the second heat exchange passage 42 and the exhaust port a. That is to say, when the second control valve 421 controls the refrigerant to flow, the refrigerant in the compressor 2 may be directly discharged from the exhaust port a into the second heat exchange passage 42 to perform heat exchange, and the refrigerant is discharged from the second connector 12 into the refrigerant flow direction switching device after the heat exchange. Thus, when the outdoor heat exchanger 4 is defrosting, the refrigerant with high temperature and high pressure is directly discharged into the second heat exchange passage 42, when cold water generated by the defrosting of the outdoor heat exchanger 4 flows downwards, a bottom portion of the outdoor heat exchanger 4 may be heated by the refrigerant with high temperature and high pressure, and then the liquid water after the defrosting may directly leak out via a water hole of a base located under the outdoor heat exchanger 4, such that the water hole will not be blocked due to icing, thus avoiding a safety risk.

Optionally, the throttling element 6 is an electronic expansion valve, and the electronic expansion valve is responsive and has a certain energy-saving effect, so the use of the electronic expansion valve not only meets the use requirement, but also improves sensibility of the throttling element 6 and reduces energy consumption to some extent. Of course, it should be understood that, the throttling element 6 may be formed as other structures, and for example, the throttling element 6 may be a thermal expansion valve, or a capillary tube and a control valve connected in series.

According to some embodiments of the present invention, the outdoor unit 100 further includes a gas supplement passage 7, two ends of the gas supplement passage 7 are connected to the exhaust port a and the second connector 12 respectively, and a third control valve 71 for controlling the refrigerant to flow or stop is connected to the gas supplement passage 7 in series.

Optionally, the third control valve 71 is a solenoid valve, which has a simple structure and a low cost, and is responsive, so the third control valve 71 configured as the solenoid valve not only meets the use requirement, but also reduces the cost to some extent and saves the assembling space. However, it should be understood that, the third control valve 71 may not be limited to the solenoid valve, and may also be other elements, as long as they may control the refrigerant to flow or stop.

When the third control valve 71 is opened, the refrigerant discharged from the exhaust port a of the compressor 2 may directly flow to the second connector 12 to be discharged from the outdoor unit 100. Thus, when the outdoor unit 100 operates in the first mode and the requirement of the heat recovery VRF air conditioning system is smaller, the outdoor heat exchanger 4 may be closed by closing all of the first control valves 411, such that the refrigerant discharged from the exhaust port a of the compressor 2 may flow to the second connector 12 only via the third control valve 71, which may meet a smaller power requirement by adjusting the opening degree of the third control valve 71. Meanwhile, by providing the gas supplement passage 7, when the outdoor unit 100 operates in the first mode, the suitable gaseous refrigerant may be supplemented into the heating indoor units by adjusting the third control valve 71.

In some embodiments of the present invention, the outdoor unit 100 for the heat recovery VRF air conditioning system further includes an oil separator 8, the oil separator 8 includes a first inlet g, a refrigerant outlet h and an oil outlet i, the first inlet g is connected to the exhaust port a, the refrigerant outlet h is connected to the first valve port c, and the oil outlet i is connected to the gas return port b. Thus, by connecting the oil separator 8 in series between the compressor 2 and the first valve port c, the refrigerant mixed with a lubricating oil and discharged from the exhaust port a enters the oil separator 8 and is separated therein, the separated lubricating oil is discharged into the compressor 2 via the oil outlet i and the gas return port b, and the separated refrigerant is discharged into the reversing assembly 3 via the refrigerant outlet h. Further the lubricating oil discharged from compressor 2 may be recycled, which avoids a failure of the compressor 2 due to an oil shortage, and improves the operational reliability of the outdoor unit 100.

The heat recovery VRF air conditioning system according to embodiments of the present invention, by providing the above-described outdoor unit 100 for the heat recovery VRF air conditioning system, may improve the suction-superheat degree of the compressor 2, and meanwhile improve the energy efficiency of the heat recovery VRF air conditioning system.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature. Reference throughout this specification to "an embodiment," "some embodiments," "an example," "a specific example," or "some examples," device that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art can combine the different embodiments or examples and the features of the different embodiments or examples described in this specification without conflicting situations.

Although explanatory embodiments have been shown and described, it would be appreciated that the above embodiments cannot be construed to limit the present disclosure, and changes, alternatives, and modifications can be made in the embodiments within the scope of the present disclosure by those skilled in the art.

What is claimed is:

1. An outdoor unit for a heat recovery variable refrigerant flow (VRF) air conditioning system, having a first connector and a second connector, and comprising:

a compressor, having an exhaust port and a gas return port;

a reversing assembly, having a first valve port, a second valve port, a third valve port and a fourth valve port, the first valve port being connected to the exhaust port, the second valve port being connected to the gas return port, and the third valve port being connected to the first connector;

an outdoor heat exchanger, having a first end connected to the fourth valve port, and a second end connected to the second connector;

a plurality of one-way valves, wherein each one-way valve has a circulation end and a stop end, and each one-way valve is opened only in one direction from the circulation end to the stop end; the plurality of one-way valves comprise a first one-way valve, a second one-way valve, a third one-way valve, a fourth one-way valve, a fifth one-way valve and a sixth one-way valve;

the circulation end of the first one-way valve is connected to the fourth valve port, and the stop end of the first one-way valve is connected to the first end of the outdoor heat exchanger; the circulation end of the second one-way valve is connected to the first connector, and the stop end of the second one-way valve is connected to the third valve port; the circulation end of the third one-way valve is connected between the second one-way valve and the first connector, and the stop end of the third one-way valve is connected to the first end of the outdoor heat exchanger; the circulation end of the fourth one-way valve is connected to the second end of the outdoor heat exchanger, and the stop end of the fourth one-way valve is connected to the second connector; the circulation end of the fifth one-way valve is connected between the second one-way valve and the third valve port, and the stop end of the fifth one-way valve is connected between the fourth one-way valve and the second connector; the circulation end of the sixth one-way valve is connected between the fourth one-way valve and the outdoor heat exchanger, and the stop end of the sixth one-way valve is connected between the first one-way valve and the fourth valve port;

a throttling element, connected in series between the third one-way valve and the outdoor heat exchanger; and a gas-liquid separator, comprising a second inlet and a gas outlet, the second inlet being connected to the second valve port, and the gas outlet being connected to the gas return port.

2. The outdoor unit according to claim 1, wherein the outdoor heat exchanger comprises a plurality of first heat exchange passages arranged successively in an up-and-down direction, and a first control valve for controlling a refrigerant to flow or stop is connected in series between a first end of each first heat exchange passage and the first one-way valve.

3. The outdoor unit according to claim 2, further comprising:

a plurality of seventh one-way valves, wherein the plurality of seventh one-way valves are provided in one to one correspondence with the plurality of first heat exchange passages, a circulation end of each seventh one-way valve is connected to a second end of the corresponding first heat exchange passage, and a stop end of each seventh one-way valve is connected to the sixth one-way valve.

4. The outdoor unit according to claim 3, further comprising:

a gas supplement passage, wherein two ends of the gas supplement passage are connected to the exhaust port and the second connector respectively, and a third control valve for controlling a refrigerant to flow or stop is connected in series to the gas supplement passage.

5. The outdoor unit according to claim 2, wherein the outdoor heat exchanger further comprises a second heat exchange passage located at the lowest portion thereof, two ends of the second heat exchange passage are connected to the exhaust port and the second connector respectively, and a second control valve for controlling the refrigerant to flow or stop is connected in series between the second heat exchange passage and the exhaust port.

6. The outdoor unit according to claim 5, further comprising:

a gas supplement passage, wherein two ends of the gas supplement passage are connected to the exhaust port and the second connector respectively, and a third control valve for controlling a refrigerant to flow or stop is connected in series to the gas supplement passage.

7. The outdoor unit according to claim 2, wherein the throttling element is an electronic expansion valve.

8. The outdoor unit according to claim 7, further comprising:

a gas supplement passage, wherein two ends of the gas supplement passage are connected to the exhaust port and the second connector respectively, and a third control valve for controlling a refrigerant to flow or stop is connected in series to the gas supplement passage.

9. The outdoor unit according to claim 2, further comprising:

a gas supplement passage, wherein two ends of the gas supplement passage are connected to the exhaust port and the second connector respectively, and a third control valve for controlling a refrigerant to flow or stop is connected in series to the gas supplement passage.

10. The outdoor unit according to claim 1, further comprising:

a gas supplement passage, wherein two ends of the gas supplement passage are connected to the exhaust port and the second connector respectively, and a third control valve for controlling a refrigerant to flow or stop is connected in series to the gas supplement passage.

11. The outdoor unit according to claim 10, wherein the third control valve is a solenoid valve.

12. The outdoor unit according to one of claims 1, further comprising:

an oil separator, wherein the oil separator comprises a first inlet, a refrigerant outlet and an oil outlet, the first inlet is connected to the exhaust port, the refrigerant outlet is connected to the first valve port, and the oil outlet is connected to the gas return port.

13. A heat recovery variable refrigerant flow (VRF) air conditioning system, comprising:

an outdoor unit for a heat recovery VRF air conditioning system, having a first connector and a second connector, and comprising:

a compressor, having an exhaust port and a gas return port;

a reversing assembly, having a first valve port, a second valve port, a third valve port and a fourth valve port, the first valve port being connected to the exhaust port, the second valve port being connected to the gas return port, and the third valve port being connected to the first connector;

an outdoor heat exchanger, having a first end connected to the fourth valve port, and a second end connected to the second connector;

a plurality of one-way valves, wherein each one-way valve has a circulation end and a stop end, and each one-way valve is opened only in one direction from the circulation end to the stop end; the plurality of one-way valves comprise a first one-way valve, a second one-way valve, a third one-way valve, a fourth one-way valve, a fifth one-way valve and a sixth one-way valve; the circulation end of the first one-way valve is connected to the fourth valve port, and the stop end of the first one-way valve is connected to the first end of the outdoor heat exchanger; the circulation end of the second one-way valve is connected to the first connector, and the stop end of the second one-way valve is connected to the third valve port; the circulation end of the third one-way valve is connected between the second one-way valve and the first connector, and the stop end of the third one-way valve is connected to the first end of the outdoor heat exchanger; the circulation end of the fourth one-way valve is connected to the second end of the outdoor heat exchanger, and the stop end of the fourth one-way valve is connected to the second connector; the circulation end of the fifth one-way valve is connected between the second one-way valve and the third valve port, and the stop end of the fifth one-way valve is connected between the fourth one-way valve and the second connector; the circulation end of the sixth one-way valve is connected between the fourth one-way valve and the outdoor heat exchanger, and the stop end of the sixth one-way valve is connected between the first one-way valve and the fourth valve port;

a throttling element, connected in series between the third one-way valve and the outdoor heat exchanger; and a gas-liquid separator, comprising a second inlet and a gas outlet, the second inlet being connected to the second valve port, and the gas outlet being connected to the gas return port.

14. The heat recovery VRF air conditioning system according to claim 13, wherein the outdoor heat exchanger comprises a plurality of first heat exchange passages arranged successively in an up-and-down direction, and a first control valve for controlling a refrigerant to flow or stop is connected in series between a first end of each first heat exchange passage and the first one-way valve.

15. The heat recovery VRF air conditioning system according to claim 14, further comprising:

a plurality of seventh one-way valves, wherein the plurality of seventh one-way valves are provided in one to one correspondence with the plurality of first heat exchange passages, a circulation end of each seventh one-way valve is connected to a second end of the corresponding first heat exchange passage, and a stop end of each seventh one-way valve is connected to the sixth one-way valve.

16. The heat recovery VRF air conditioning system according to claim 14, wherein the outdoor heat exchanger further comprises a second heat exchange passage located at the lowest portion thereof, two ends of the second heat exchange passage are connected to the exhaust port and the second connector respectively, and a second control valve for controlling the refrigerant to flow or stop is connected in series between the second heat exchange passage and the exhaust port.

17. The heat recovery VRF air conditioning system according to claim 14, wherein the throttling element is an electronic expansion valve.

18. The heat recovery VRF air conditioning system according to claim 13, further comprising:

a gas supplement passage, wherein two ends of the gas supplement passage are connected to the exhaust port and the second connector respectively, and a third control valve for controlling a refrigerant to flow or stop is connected in series to the gas supplement passage.

19. The heat recovery VRF air conditioning system according to claim 18, wherein the third control valve is a solenoid valve.

20. The heat recovery VRF air conditioning system according to claim 13, further comprising:

an oil separator, wherein the oil separator comprises a first inlet, a refrigerant outlet and an oil outlet, the first inlet is connected to the exhaust port, the refrigerant outlet is connected to the first valve port, and the oil outlet is connected to the gas return port.

* * * * *